US006781301B1

(12) United States Patent
Jeong

(10) Patent No.: US 6,781,301 B1
(45) Date of Patent: Aug. 24, 2004

(54) CATHODE-RAY TUBE

(75) Inventor: Hoon Jeong, Gumi-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/295,949

(22) Filed: Nov. 18, 2002

(30) Foreign Application Priority Data

Jun. 25, 2002 (KR) ..... 2002/35513

(51) Int. Cl.[7] ..... H01J 31/00

(52) U.S. Cl. ..... 313/477 R; 313/479; 313/402; 313/408

(58) Field of Search ..... 313/477–479, 313/402, 408, 403, 477 R; 220/2.1 R, 2.1 A, 2.3 A

(56) References Cited

U.S. PATENT DOCUMENTS 5,534,746 A * 7/1996 Marks et al. ..... 313/408
6,066,914 A * 5/2000 Shimizu et al. ..... 313/477 R
6,072,270 A * 6/2000 Hu et al. ..... 313/402
6,160,344 A * 12/2000 Cho et al. ..... 313/477 R
6,465,945 B1 * 10/2002 Tsuchida et al. ..... 313/461
6,548,954 B1 * 4/2003 Ishii et al. ..... 313/467
6,570,310 B1 * 5/2003 Aibara ..... 313/403
6,639,346 B2 * 10/2003 Bae et al. ..... 313/461

* cited by examiner

*Primary Examiner*—Nimeshkumar D. Patel
*Assistant Examiner*—German Colón
(74) *Attorney, Agent, or Firm*—Birch, Stewart, Kolasch & Birch, LLP

(57) ABSTRACT

A color cathode-ray tube employs a tint or dark tint glass panel having optimal transmittance in order to solve a problem of brightness balance of a periphery to a center of a screen becoming degraded due to a difference between glass transmittances. The cathode-ray tube comprises a panel, an external surface of which is substantially flat and an internal surface of which has a fluorescent screen with a predetermined curvature, and a shadow mask which is placed at a predetermined distance apart from the internal surface of the panel and has a plurality of electron beam through-holes formed therein.

8 Claims, 4 Drawing Sheets

CATHODE-RAY TUBE

This nonprovisional application claims priority under 35 U.S.C. § 119(a) Patent Application No. 2002-0035513 filed in KOREA on Jun. 25, 2002, which is herein incorporated by reference.

BACKGROUND OF THE INVENTION

1. Field of the Invention

The present invention relates to a color cathode-ray tube, and more particularly to a cathode-ray tube employing a tint or dark tint glass panel in which an optimal transmittance is achieved by solving a problem of deterioration of a brightness balance of the periphery of the screen and the center of the screen caused by the difference between the transmittances in the center and periphery of the screen.

2. Background of the Related Art

FIG. 1 illustrates a configuration of a related art flat color cathode-ray tube.

Referring to FIG. 1, the related flat color cathode-ray tube forms a vacuum tube by which a front side glass panel 1 is combined with a rear side glass funnel 2 and sealed up, and therefore its interior is maintained in a vacuum state.

A fluorescent screen 4 is formed on the internal surface of the panel 1. An electron gun assembly 13 is installed in a neck of the funnel 2 facing the fluorescent screen 4.

A shadow mask 7 that performs a color selection is installed between the fluorescent screen 4 and the electron gun assembly 13 at a predetermined distance from the fluorescent screen 4. The shadow mask 7 is fitted to a mask frame 3 and upheld elastically by a spring 8 in order to be supported by the panel 1 with a stud pin 12.

The mask frame 3 is coupled to an inner shield 9 made of magnetic materials to reduce an effect of the terrestrial magnetic field in the rear portion of the cathode-ray tube for reducing the movements of electron beams caused by an external magnetic field.

A Convergence Purity Magnet (CPM) 10 for adjusting red (R), green (G), blue (B) electron beams is installed in the neck of the funnel 2 in order to converge the electron beams 6 into a single point, and a deflection yoke 5 is also placed for deflecting the electron beams.

In addition, a reinforcement band 11 is installed to reinforce the front side glass according to the internal vacuum state.

The operation of the above-described flat color cathode-ray tube is illustrated hereinafter. The electron beams 6 emitted from the electron gun assembly 13 are deflected in vertical and horizontal directions by the deflection yoke. The deflected beams pass through beam through-holes of the shadow mask 7 and land on the front side of the fluorescent screen 4, thereby displaying a desired color image.

Here, the CPM 10 adjusts the convergence and purity of the R, G, B electron beams 6. The inner shield 9 blocks the effect of the terrestrial magnetic field from the rear side of the cathode-ray tube.

FIG. 2 illustrates the structure of the shadow mask.

Referring to FIGS. 1 and 2, the shadow mask 7 is placed in a dome shape while maintaining a predetermined distance from the internal surface of the panel 1.

The shadow mask 7 is comprised of an effective surface portion 31 having a plurality of slots which are dot or stripe type electron beam through-holes formed in the center, an ineffective surface portion 32 surrounding the effective surface portion 31 without the slots, and a mask skirt 33 cut and curved vertically from the ineffective surface portion 32 at the outermost portions of the skirt.

The frame 3 is welded onto the mask skirt 33.

The shadow mask 7 has a 0.1 to 0.3 mm thickness and comprises the plurality of slots 34, which are passages through which the electron beams 6 pass and, are formed in a predetermined arrangement in the effective surface portion 31. The slots 34 are arranged in a plurality of rows whose dot or stripe type holes have a predetermined pitch.

This flat color cathode-ray tube reproduces an image by deflecting the electron beams 6 that have been emitted from the electron gun assembly 13 mounted on the end of the funnel 2 in up, down, right and left directions with the deflection yoke 5 mounted on the external surface of the funnel 2. Thereafter, the deflected electron beams land on the fluorescent screen 4 formed on the internal surface of the panel 1 by passing through the shadow mask 7 having the plurality of the through-holes and functions as a color selector.

At this time, brightness and darkness of the image depend largely on a degree of illumination of the fluorescent screen 4 formed on the internal surface of the panel 1 by the electron beams 6, and an amount of the electron beams 6 passing through the slots 34 that are stripe-type holes formed in the shadow mask 7.

When the electron beams 6 pass the slots 34 (the electron beam through-holes) of the shadow mask 7, their transmittance is about 14 to 20%. The transmittance of the electron beams passing through the fluorescent screen 4 that has been spread on the internal surface of the panel 1 after passing through the shadow mask 7 is 45 to 60%.

Finally, the electron beams 6 pass the panel 1 to display the image.

In the panel 1 of the conventional color cathode-ray tube, a clear glass, the central transmittance of which is above 75% has a final central transmittance of about 54% and a peripheral transmittance of 47%.

When a tint glass or dark tint glass is employed as a panel, a contrast characteristic indicating definition becomes improved but the peripheral transmittance drops sharply, and as a result, the problem of deterioration in brightness balance of the periphery to the center occurs.

That is, the clear glass has a final central transmittance of about 54% and a peripheral transmittance of about 47%, but the tint glass has transmittances of about 54% and 35%, respectively. Thus, the peripheral transmittance is substantially lowered in a case of the tint glass when compared with the clear glass causing the central to peripheral brightness balance to be deteriorated.

To solve these problems, a method for reducing the thickness of the panel 1 to improve the transmittance of the panel 1 has been studied.

With respect to a shape of the panel 1, the external surface is almost flat and the internal surface has a kind of dome shape, the center of which is the thinnest, and the panel becomes thicker toward the periphery. Therefore, reducing the thickness means making the dome shape of the internal surface of the panel 1 flat.

If this is done, however, the shape of the shadow mask 7, the curvature of which is similar to the curvature of the dome shape of the internal surface of the panel 1 should also be flat.

As the shadow mask 7 becomes flat, its structural strength is weakened causing problems such as a howling effect.

In addition, since curvature deformation caused by small shocks or collisions occur relatively easily due to the structural weakening, a problem of generating image distortion may occur.

SUMMARY OF THE INVENTION

An object of the invention is to solve at least the above problems and/or disadvantages and to provide at least the advantages described hereinafter.

The present invention is for a cathode-ray tube and has an object of solving a foregoing problem of degradation in a brightness balance of the periphery to center of a screen due to a difference between glass transmittances for a cathode-ray tube employing a tint or a dark tint glass panel.

The foregoing object and advantages are realized by providing a cathode-ray tube comprising a panel having a substantially flat external surface and an internal surface formed with a fluorescent screen in a predetermined curvature, and a shadow mask placed a predetermined distance apart from the internal surface of the panel and a plurality of electron beam through-holes are formed therein, wherein the cathode-ray tube is characterized by having a central transmittance of the panel as 40–75%, a transmittance ratio of the center to a periphery of the panel as 1.4~2.2, and the ratio of the peripheral transmittance to the central transmittance satisfying the following relationship: $0.85 \leqq Tmd/Tmc \leqq 1.00$, wherein, Tmd is the peripheral transmittance and Tmc represents the central transmittance.

A cathode-ray tube according to the present invention has advantages of improving the brightness balance and definition of the screen by raising the brightness of the periphery by improving distribution of the transmittances of the center and periphery in order to raise the ratio of the central to peripheral transmittances.

There is an additional advantage of improving contrast by employing a high definition panel such as tint or dark tint glass.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode-ray tube according to a preferred embodiment of the invention with reference to the accompanying drawings and tables.

The present invention is for a cathode-ray tube comprising a panel whose external surface is substantially flat and internal surface has a fluorescent screen in a predetermined curvature and a shadow mask which is located in a predetermined distance apart from the internal surface of the panel and a plurality of electron beam through holes are formed in, characterized in that central transmittance of the panel is 40~75%, transmittance ratio (Tc/Td) of center (Tc) to periphery (Td) of the panel is 1.4~2.2, and the peripheral transmittance (Tmd) and the central transmittance (Tmc) in the shadow mask has a relationship of $0.85 \leqq Tmd/Tmc \leqq 1.00$.

The electron beams emitted from the electron gun assembly pass through the slots formed in the shadow mask to land on the fluorescent screen formed on the internal surface of the panel, and then light generated at this time pass through the panel of tint glass to be displayed as an image.

The tint glass panel described above is a panel that has a central transmittance of 40~75% and the Tc/Td ratio of the central transmittance (Tc) to the peripheral transmittance (Td) is 1.4~2.2, and a contrast which indicates clearness of the screen is enhanced.

Only about 14~20% among the electron beams emitted from the electron gun assembly pass through the slots of the shadow mask. The sizes of the slots are differed depending on the position of the shadow mask, and thereby the transmittance (Tm) of the electron beams passing through the slots of the shadow mask also changes.

Figure 3:
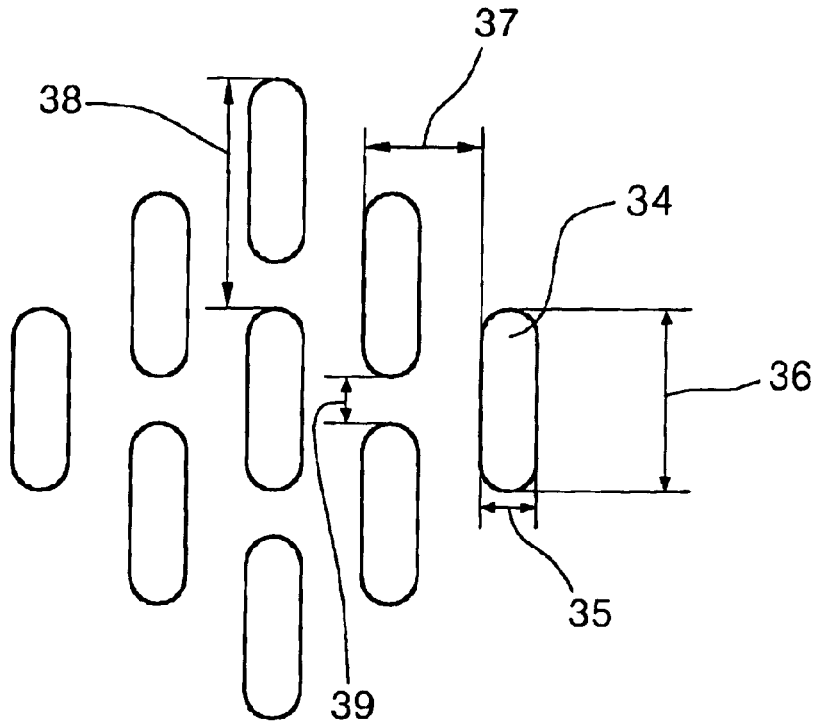
FIG. 3 shows enlarged slots of the shadow mask in order to illustrate a cathode-ray tube according to the present invention.

FIG. 3 shows an enlarged view of slots of the shadow mask in order to illustrate the cathode-ray tube according to the present invention.

The slot 34 of the shadow mask is divided into an input part to which the electron beams emitted from the electron gun assembly are inputted, and an output part from which the electron beams that have passed through the shadow mask are directed to a screen. The size of the slot 34 of the input part is generally smaller than the output part.

The shadow mask slots 34 described in the present invention refer to a traveling direction of the electron beams.

Referring to FIG. 3, the slots 34 are in a rectangular shape having a horizontal width 35 and a vertical height 36.

A bridge(Br) 39 formed between the adjacent slots 34 in a vertical direction and the height(Sl) 36 of the slots 34 are called vertical pitch(Pv) 38. The distance between the adjacent slots in a horizontal direction and the width(Sw) 35 of the slots 34 is called horizontal pitch(Ph) 37.

The transmittance of the shadow mask is determined by the horizontal pitch(Ph) 37, the slot width(Sw) 35, the vertical pitch(Pv) 38 and the bridge(Br) 39.

That is, the transmittance (Tm) of the shadow mask is calculated by the following equation 1.

[Equation 1]

$$Tm = Sw \times \frac{Pv - Br}{Pv \times Ph} \times 100(\%) \quad (1)$$

According to the equation 1, the transmittance may be calculated as the area of the slot/an effective area of the shadow mask.

Figure 1:
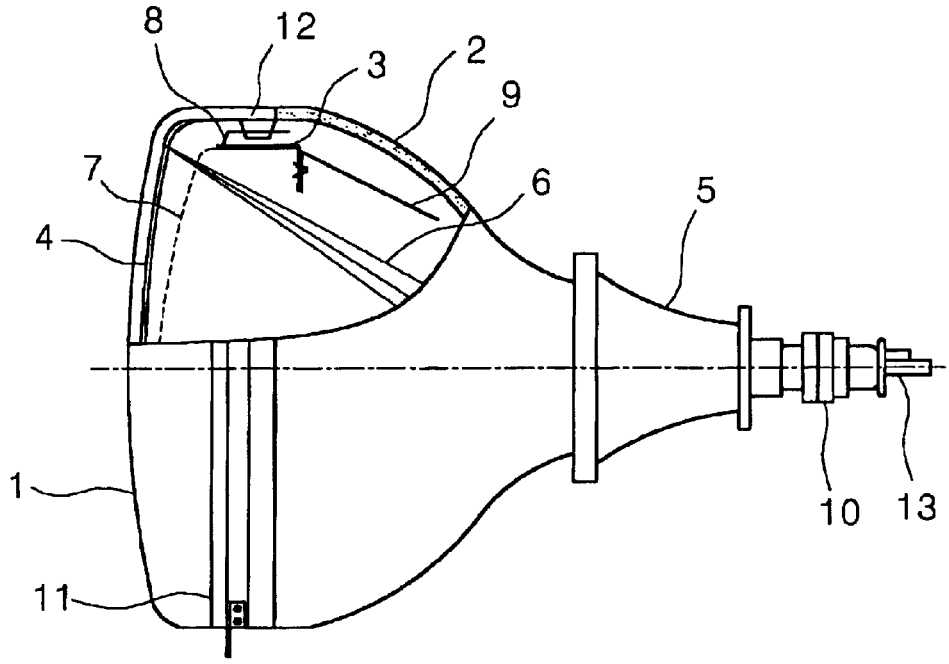
FIG. 1 (Related art)
FIG. 1 is a perspective view illustrating a configuration of a related flat cathode-ray tube.
Figure 2:
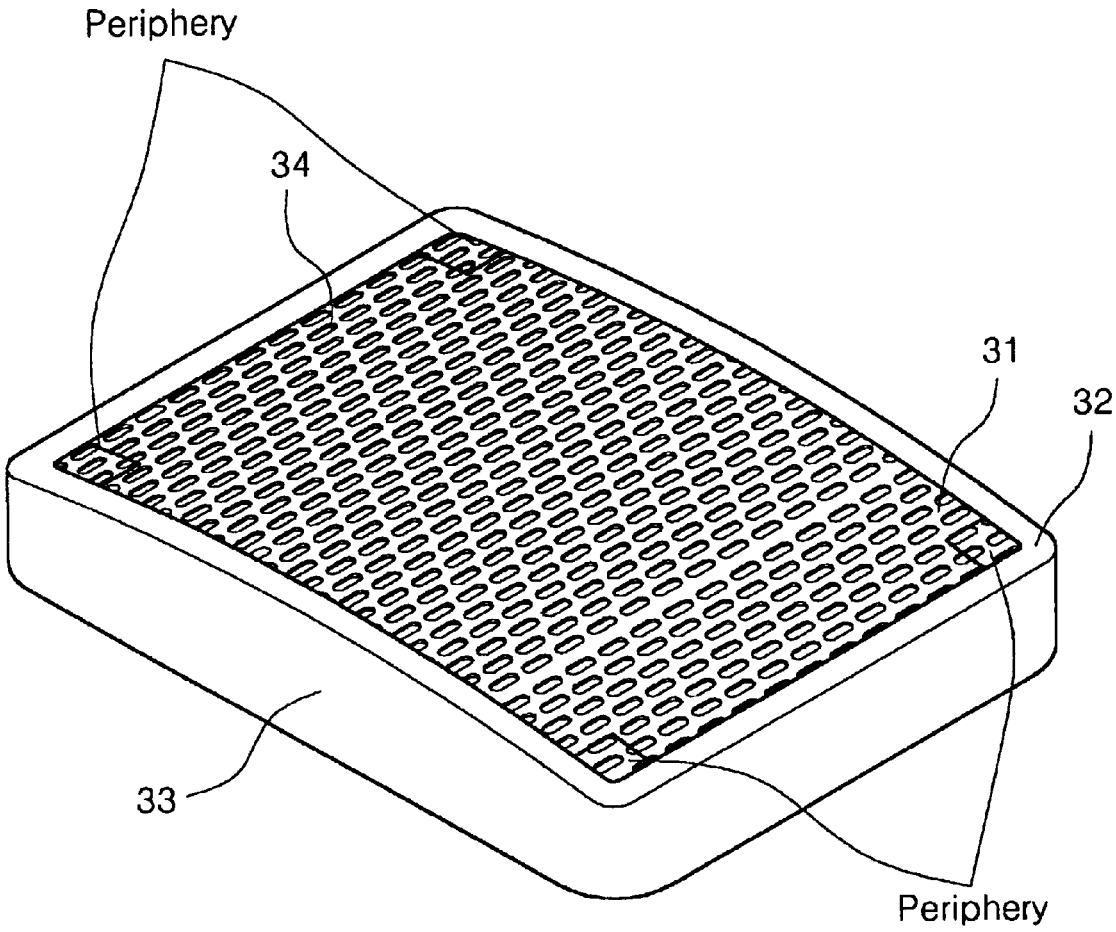
FIG. 2 is a perspective view illustrating the structure of a shadow mask.

The following table 1 illustrates the central transmittance (Tmc) and the peripheral transmittance (Tmd) of the shadow mask. Here, the periphery, as shown in FIG. 2, refers to diagonal end areas of the effective surface portion of the shadow mask.

TABLE 1

| | Tmc | Tmd | Tmd/Tmc |
|---|---|---|---|
| Related art 1 | 20.1% | 16.5% | 0.82 |
| Related art 2 | 19.2% | 15.9% | 0.83 |
| Embodiment 1 | 19.0% | 18.4% | 0.97 |
| Embodiment 2 | 18.9% | 18.8% | 1.00 |

As shown in Table 1, for the transmittance of the shadow mask employed in the related flat cathode-ray tube, the ratio (Tmd/Tmc) of the peripheral transmittance (Tmd) to the central transmittance (Tmc) is about 0.82~0.83.

However, the ratio (Tmd/Tmc) of the peripheral transmittance (Tmd) to the central transmittance (Tmc) of the shadow mask of the flat cathode-ray tube employing the tint glass panel in accordance with the present invention is about 0.97 to 1.00, and therefore the brightness of the periphery is enhanced in that the peripheral transmittance is higher than the peripheral transmittance of the related art.

That is, the peripheral brightness of the shadow mask is improved by meeting the following condition: $0.97 \leqq Tmd/Tmc \leqq 1.00$.

For example, in the periphery of the shadow mask, when the horizontal pitch (Phd) is 1.057 mm, the vertical pitch (Pvd) is 0.720 mm, the slot width (Swd) is 0.245 mm and the bridge (Brd) is 0.149 mm, the peripheral transmittance (Tmd) becomes $$0.245 \times \frac{0.720 - 0.149}{0.720 \times 1.057} \times 100 = 18.4\%.$$

In the center of the shadow mask, when the horizontal pitch (Phc) is 0.770 mm, the vertical pitch (Pvc) is 0.720 mm, the slot width (Swc) is 0.176 mm and the bridge (Brd) is 0.120 mm, the central transmittance (Tmc) becomes $$0.176 \times \frac{0.720 - 0.120}{0.720 \times 0.770} \times 100 = 19.0\%$$

Accordingly, the peripheral transmittance to the value of the central transmittance (Tmd/Tmc) is 0.965.

At this time, the peripheral transmittance of the tint shadow mask is preferably greater than or equal to the peripheral transmittance of the conventional flat cathode-ray tube.

That is, the peripheral transmittance of the tint shadow mask is preferably 17% or greater.

Table 2 illustrates the bridge and vertical pitch of the periphery.

TABLE 2

| | Brd | Pvd | Brd/Pvd |
|---|---|---|---|
| Related art 1 | 0.149 mm | 0.595 mm | 0.25 |
| Related art 2 | 0.142 mm | 0.595 mm | 0.24 |
| Embodiment 1 | 0.149 mm | 0.720 mm | 0.21 |
| Embodiment 2 | 0.120 mm | 0.595 mm | 0.20 |

As shown in table 2, in the related art periphery, the ratio (Brd/Pvd) of the bridge (Brd) to the vertical pitch (Pvd) is 0.24~0.25 and preferably should be smaller than 0.24 so that the transmittance of the shadow mask can be raised.

However, if the above Brd/Pvd ratio is smaller than 0.15, the size of the bridge becomes 0.090 mm when the generally applied vertical pitch (Pvd) is 0.600 mm.

When the size of the bridge is 0.090 mm, the bridge becomes very small during the mask forming process such that the problem of the bridge being torn may occur.

Accordingly, the Brd/Pvd ratio of the bridge (Brd) to the vertical pitch (Pvd) of the periphery satisfies the following condition: $0.16 \leqq Brd/Pvd \leqq 0.23$.

The bridge (Brd) of the shadow mask should be larger than 0.090 mm and smaller than the conventional size of 0.142 mm in order to increase the peripheral transmittance of the shadow mask.

Accordingly, the size of the bridge (Brd) is preferably $0.10\ mm \leqq Brd \leqq 0.14\ mm$.

Meanwhile, the factors that determine the transmittance of the shadow mask other than the vertical pitch (Pvd) and bridge (Brd) are the horizontal pitch (Phd) and slot width (Swd).

The slot width (Swd) of the shadow mask of the cathode-ray tube employing the tint glass panel is determined by the following equation 2.

Figure 4:
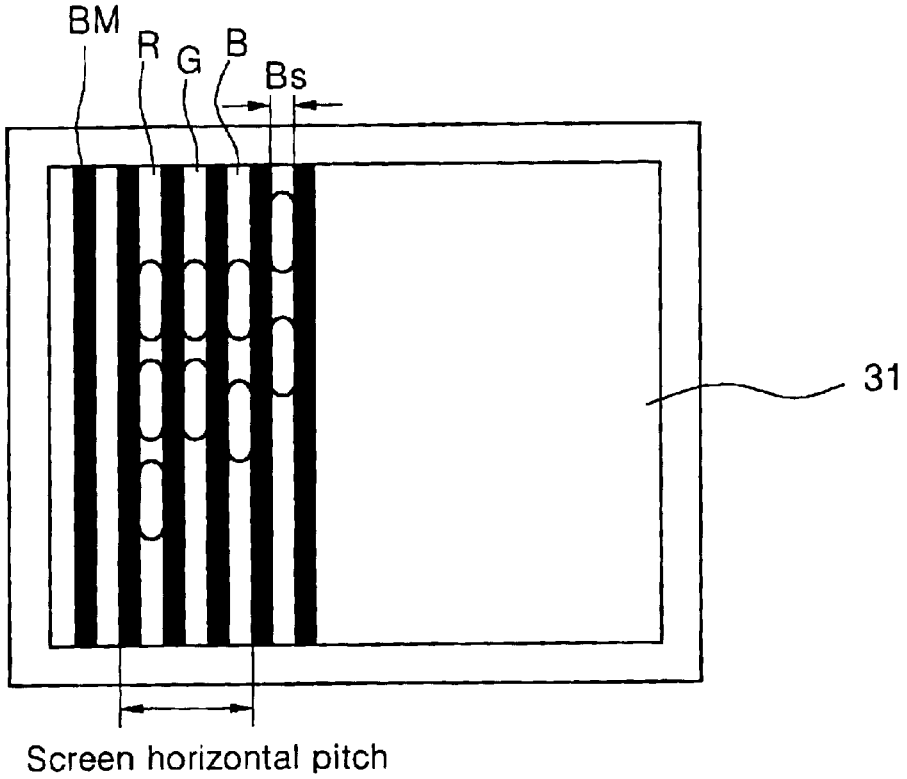
FIG. 4 shows electron beams, passing through the slots of the shadow mask, for illustrating a cathode-ray tube according to the present invention.

[Equation 2]

$$\left(\frac{Ph}{3}\right) \times \left(\frac{A}{B}\right) \times 0.9 \leq Swd \leq \left(\frac{Ph}{3}\right) \times \left(\frac{A}{B}\right) \tag{2}$$

where, A is a predetermined constant indicating a ratio of horizontal pitch of a screen to slot pitch (Ph) of the shadow mask, where the screen is comprised of 3 graphite strips lying close by and R, G, B of the fluorescent materials spread on the internal surface of the panel of FIG. 4. The value of A of the periphery is about 1.175.

B is also a predetermined constant representing a ratio Bs/Sw of the size (Bs) of the electron beams passing through the slots, the electron beam through holes of the shadow mask of FIG. 4 to the slot width (Sw) of the shadow mask. The B value of the periphery is about 1.593.

Accordingly, the slot width (Swd) of the periphery of the shadow mask of the present invention has a relation with the horizontal pitch (Phd) of the periphery of the shadow mask like the following equation 3.

[Equation 3]

$$Phd \times 0.2213 \leqq Swd \leqq Phd \times 0.2459 \tag{3}$$

where Phd is the horizontal pitch and Swd is the slot width.

As shown in equation 3, the slot width (Swd) of the periphery should be equal to or larger than the horizontal pitch (Phd) multiplied by 0.2213, and less than or equal to the horizontal pitch multiplied by 0.2459.

If the slot width (Swd) is smaller than the horizontal pitch (Phd) multiplied by 0.2213 in the periphery as in the case in which the horizontal pitch (Phd) is 1.040 mm and the slot width (Swd) is 0.220 mm, the size of the electron beams that passed through the slot width (Swd) of 0.220 mm becomes approximately 0.350 mm (0.220×1.593).

At this time, the horizontal pitch (P) of the screen becomes approximately 1.220 mm(=1.040×1.175). Accordingly, as the size occupied by the electron beams in the horizontal pitch (P) of the screen becomes smaller, the electron beams may not strike the exact positions of the R, G, B fluorescent materials resulting in sharp deterioration of the brightness.

On the other hand, if the slot width (Swd) is larger than the horizontal pitch (Phd) multiplied by 0.2459, the size of the electron beams that have passed through the slot width (Swd) of 0.275 mm becomes approximately 0.438 mm (0.275×1.593) which is larger than 0.407 mm, a value of ⅓ of the screen horizontal pitch (P) in size of 1.220 mm.

At this time, the color purity can be deteriorated due to an error in positions of beam landing on the R, G, B fluorescent materials.

Accordingly, it is preferable that the slot width satisfies the equation 3.

The following table 3 illustrates the ratio Swd/Swc of the slot width (Swd) of the periphery to the slot width (Swc) of the center of the shadow mask.

TABLE 3

| | Swc | Swd | Swd/Swc |
|---|---|---|---|
| Related art 1 | 0.189 mm | 0.213 mm | 1.13 |
| Related art 2 | 0.182 mm | 0.226 mm | 1.24 |
| Embodiment 1 | 0.176 mm | 0.245 mm | 1.39 |
| Embodiment 2 | 0.175 mm | 0.245 mm | 1.40 |

In order to increase the peripheral transmittance in the shadow mask, the Swd/Swc value should be larger than 1.3, which is larger than the related values 1.13~1.24. If the Swd/Swc value is larger than 1.6, the Swd should be larger than 0.280 mm because the minimum slot width (Swc) needed to form the slots of the shadow mask is 0.175 mm. As a result, the size of the electron beams having passed the slots of the shadow mask is too large to cause deterioration in the color purity.

Accordingly, it is preferable that the Swd/Swc should satisfy the following condition: $1.3 \leqq Swd/Swc \leqq 1.5$.

Since the thickness (T) of the shadow mask is 0.22~0.25 mm and the minimum slot width (Swc) needed to form the slots of the shadow mask is 0.175 mm, Swc/T becomes 0.175/0.22=0.79 if the thickness of the shadow mask is 0.22 mm, and if the thickness is 0.25 mm then Swc/T is 0.7. That is, Swc/T becomes 0.7~0.79.

If Swc/T is smaller than 0.7 due to the Swc being smaller than the thickness (T) of the shadow mask, it is difficult to form the slots by means of etching. If the Swc/T is larger than 0.79, the structural strength of the shadow mask is weakened.

Accordingly, it is preferable that the Swc/T satisfies the following condition: $0.7 \leqq Swc/T \leqq 0.79$ The following table 4 is an embodiment of the tint shadow mask.

TABLE 4

| | Central transmittance | Peripheral transmittance |
|---|---|---|
| Ph | 77.0% | 105.7% |
| Pv | 72.0% | 72.0% |
| Sw | 17.6% | 24.5% |
| Br | 12.0% | 14.9% |

Referring to table 4, the central transmittance (Tmc) of the shadow mask in accordance with the equation 1 is 19.0% and its peripheral transmittance (Tmd) is 18.4%, thus the peripheral transmittance becomes 18.4% satisfying the formula $Tmd \geqq 17\%$.

Furthermore, Tmd/Tmc is 0.965 which also satisfies the formula $0.80 \leqq Tmd/Tmc$.

The peripheral vertical pitch (Pvd) is 0.720 mm and the bridge (Brd) is 0.149. Therefore, Brd/Pvd becomes 0.21, thereby satisfying the condition $0.16 \leqq Brd/Pvd \leqq 0.23$.

The peripheral horizontal pitch (Phd) of the shadow mask is 1.057 mm and the slot width (Swd) is 0.245 mm, so that they are within the rage of $0.2213 \times Ph \leqq Swd \leqq 0.2459 \times Ph$. That is, the Swd satisfies the formula $0.234\ mm \leqq Swd \leqq 0.260\ mm$.

The central slot width Swc is 0.176 mm and the peripheral slot width Swd is 0.245 mm, such that the Swd/Swc becomes 1.4 and satisfies the following condition: $1.3 \leqq Swd/Swc \leqq 1.5$.

The cathode-ray tube according to the present invention has advantages of improving the brightness balance and definition of the screen by raising the brightness of the periphery through improving distribution of the transmittances of the center and periphery to raise the ratio of the central to peripheral transmittances.

The cathode-ray tube according to the present invention has an additional advantage of improving contrast by employing a high definition panel such as tint or dark tint glass.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode-ray tube comprising:

a panel whose external surface is substantially flat and whose internal surface has a fluorescent screen with a predetermined curvature; and a shadow mask which is placed a predetermined distance apart from the internal surface of the panel and which has a plurality of electron beam through-holes formed therein, wherein a central transmittance of the panel is 40~75%, a transmittance ratio of a center of the panel to a periphery of the panel is 1.4~2.2, and a ratio of the peripheral transmittance of the shadow mask to a central transmittance of the shadow mask satisfies the following relationship:

$$0.85 \leqq Tmd/Tmc \leqq 1.00,$$

where Tmd is the peripheral transmittance of the shadow mask, and Tmc is the central transmittance of the shadow mask.

2. The cathode-ray tube according to claim 1, wherein the peripheral transmittance of the shadow mask is 17% or greater.

3. The cathode-ray tube according to claim 1, wherein a ratio of an interval in a vertical direction between peripheral electron beam through holes-of the shadow mask and a vertical pitch in the vertical direction satisfies the following relationship:

$$0.16 \leqq Brd/Pvd \leqq 0.23,$$

wherein Brd is the interval in a vertical direction between peripheral electron beam through-holes of the shadow mask, and Pvd is a vertical pitch in the vertical direction.

4. The cathode-ray tube according to claim 3, wherein the interval in the vertical direction of the peripheral electron beam through-holes satisfies the following condition: 0.10 mm≦Brd≦0.14 mm.

5. The cathode-ray tube according to claim 1, wherein a horizontal pitch of the periphery of the shadow mask is Phd and a slot width of the electron beam through-holes is Swd, Swd and Phd satisfying the following relationship:

$$Phd \times 0.2213 \leqq Swd \leqq Phd \times 0.2459.$$

6. The cathode-ray tube according to claim 1, wherein a slot width of the electron beam through-holes of a center of the shadow mask is Swc and a slot width of the peripheral electron beam through-holes of the shadow mask is Swd, and the ratio of Swc and Swd satisfies the following relationship:

$$1.3 \leqq Swd/Swc \leqq 1.5.$$

7. The cathode-ray tube according to claim 1, wherein a thickness of the shadow mask is T and slot width of the central electron beam through-holes is Swc, the ratio of Swc and T satisfying the following relationship:

$$0.7 \leqq Swc/T \leqq 0.79.$$

8. A cathode-ray tube comprising:

a panel whose external surface is substantially flat and whose internal surface has a fluorescent screen with a predetermined curvature; and a shadow mask which is placed in a predetermined distance apart from the internal surface of the panel and which has a plurality of electron beam through-holes formed therein, wherein a central transmittance of the panel is 40~75%, a transmittance ratio of a center of the panel to a periphery of the panel is 1.4~2.2, a peripheral transmittance of the shadow mask is 17% or greater, and a ratio of the peripheral transmittance of the shadow mask to the central transmittance of the shadow mask satisfies the following relationship:

$$0.85 \leqq Tmd/Tmc \leqq 1.00,$$

where Tmd is the peripheral transmittance of the shadow mask, and Tmc is the central transmittance of the shadow mask.

* * * * *